US009010820B2

(12) United States Patent
Orgeron

(10) Patent No.: US 9,010,820 B2
(45) Date of Patent: Apr. 21, 2015

(54) BLOWOUT PREVENTER LIFTING APPARATUS

(71) Applicant: T&T Engineering Services, Inc., Tomball, TX (US)

(72) Inventor: Keith J. Orgeron, Spring, TX (US)

(73) Assignee: T&T Engineering Services, Inc., Tomball, TX (US)

( * ) Notice: Subject to any disclaimer, the term of this patent is extended or adjusted under 35 U.S.C. 154(b) by 0 days.

(21) Appl. No.: 14/216,423

(22) Filed: Mar. 17, 2014

(65) Prior Publication Data

US 2014/0265389 A1 Sep. 18, 2014

Related U.S. Application Data

(60) Provisional application No. 61/799,633, filed on Mar. 15, 2013.

(51) Int. Cl.
*E21B 19/06* (2006.01)
*B66C 1/62* (2006.01)

(52) U.S. Cl.
CPC ..... *B66C 1/62* (2013.01)

(58) Field of Classification Search
CPC ..... E21B 19/06; E21B 19/07; B66C 1/62
USPC ..... 294/90, 102.2, 119.2, 194
See application file for complete search history.

(56) References Cited

U.S. PATENT DOCUMENTS

| | | | | |
|---|---|---|---|---|
| 1,758,453 | A | 5/1930 | Mays | |
| 2,259,054 | A * | 10/1941 | Young | 175/423 |
| 2,875,982 | A * | 3/1959 | Unglesby | 173/126 |
| 3,458,230 | A * | 7/1969 | Jones et al. | 294/90 |
| 3,884,519 | A * | 5/1975 | McFadden | 294/90 |
| 4,275,488 | A * | 6/1981 | Gray et al. | 294/102.2 |
| 4,951,989 | A * | 8/1990 | Goodin | 294/90 |
| 5,121,793 | A | 6/1992 | Busch et al. | |
| 7,040,411 | B2 | 5/2006 | Kainer et al. | |
| 7,461,700 | B2 | 12/2008 | Livingston, Jr. et al. | |
| 7,665,530 | B2 | 2/2010 | Wells et al. | |
| 7,992,909 | B2 * | 8/2011 | Bouligny et al. | 294/102.2 |
| 2007/0062688 | A1 | 3/2007 | Schats et al. | |

* cited by examiner

*Primary Examiner* — Dean Kramer
(74) *Attorney, Agent, or Firm* — John G. Fischer, Esq.; Scheef & Stone, L.L.P.

(57) ABSTRACT

A blowout preventer (BOP) lifting apparatus has a reinforced frame and a gate for securing a BOP stack. The frame has a central U-shaped recess for securing a collared portion of the BOP stack. The gate pivotally swings between a closed position on the frame and an open position for installation and removal of the lifting apparatus from the BOP stack. An actuator has a first end connected to a top surface of the frame and a second end connected to the gate for actuating the opening and closing of the gate to the frame. When the gate is in the closed position, three locking pins are inserted into three vertical pinning holes located on the frame, which are aligned with three pinning holes located on the gate. The apparatus may be lifted via cables or other lifting mechanisms attached via lifting eyelets located on each corner of the frame.

6 Claims, 5 Drawing Sheets

BLOWOUT PREVENTER LIFTING APPARATUS

FIELD OF THE INVENTION

The present invention relates generally to an apparatus and system for handling blowout preventer ("BOP") stacks. More specifically, the present invention relates to a BOP lifting and handling device for securing and lifting a complete BOP stack during transport as well as handling at a wellhead.

BACKGROUND OF THE INVENTION

This section is intended to introduce the reader to various aspects of art that may be related to various aspects of the presently described embodiments. This discussion is believed to be helpful in providing the reader with background information to facilitate a better understanding of the various aspects of the present embodiments. Accordingly, it should be understood that these statements are to be read in this light, and not as admissions of prior art.

In the exploration of oil, gas and geothermal energy, drilling operations are used to create boreholes, or wells, in the earth. Drill rigs are typically used for such operations, and drill rigs used in subterranean exploration must be transported to the locations where drilling activity is to be commenced. Adding to the complexity, drill rigs are typically large, complex pieces of machinery that generally must be disassembled for transport and then reassembled at the destination. In a majority of these transport scenarios, the drill rigs are moved by truck and trailer.

The process for assembling the multitude of parts and components of a drill rig for drilling operations is typically known in the industry as "rig up." During rig up, crews may utilize cranes, rig up trucks, forklifts, and other specialized equipment for moving the parts of the drill rig into place. The process may be very time consuming, and may take several days to complete, depending on the type of rig being assembled and problems encountered during the process. During the rig up process, no drilling work is able to be performed. This adds to the overall cost of the drilling process in terms of crew and equipment expenses. As the drilling process cannot begin until the drill rig has been fully assembled, it is generally desirable to complete the rig up process as quickly and efficiently as possible, thereby minimizing this downtime. However, rig up is a particularly dangerous component of the drilling process, and the speed of the rig up may not be increased at the sacrifice of safety to the drilling crew.

Once drilling work has been completed at a particular well, the rig up process is performed in reverse order ("rig down") to substantially disassemble the drill rig for transport and rig up at a different location. As expected, the rig down process may require roughly the same amount of time as the rig up process and further adds to downtime and costs for operating a drill rig. While it is imperative that such downtime also be minimized, it cannot be done at the sacrifice of the safety of the drilling crew.

A particularly time consuming and labor intensive task during the rig up and rig down process is the transport and handling of the blowout preventer ("BOP") stack. As known in the oil field services industry, a BOP is a large, specialized valve installed in redundant, serial stacks that is used to seal, control and otherwise monitor the flow of liquids and gases out of oil and gas wells. Due to the extreme pressures produced by subterranean hydrocarbons, BOP stacks may have a 13" or greater bore diameter and be rated for working pressure up to and exceeding 10,000 psi. The BOP stack is installed at the wellhead beneath the drill floor so as to control the flow of fluids entering and exiting the well. Additionally, downhole equipment must pass through the BOP stack to be placed downhole. Because the BOP stack is the last line of defense in preventing a blowout, it is critical to the overall safety of the drill rig.

As understood from the above discussion, several individual BOPs are usually stacked on top of one another to form a "BOP stack." Such stacks may be several meters tall and weigh tens of thousands of pounds. Thus, BOP stacks pose a significant challenge during transportation and positioning during the rig up and rig down process. BOP stacks are at least partially disassembled for transport on trucks, as there is no practical way to transport a fully assembled BOP stack. This disassembly and subsequent reassembly process requires a significant amount of time that adds to the overall time required for rig up and rig down.

Once the BOP stack is assembled, it must be positioned under the rig floor directly over the wellhead. This procedure is also difficult and time consuming because the large BOP stack must be precision located underneath a previously erected drill rig and centered on the axis of the well. Such careful placement requires fine adjustment in at least two horizontal directions. The BOP stack may also need adjustment in the vertical direction due to potential elevation differences at the wellhead. Finally, the BOP stack must be rotated into alignment at the wellhead with one of several connectors which secure the BOP stack to the wellhead.

Most BOP handling systems and methods currently being used involve transferring the BOP stack from one piece of equipment to another, such as from a skid to an overhead lifting system. Many of these overhead lifting systems, such as cranes or trolleys, involve lifting and suspending the BOP, which consumes significant amounts of time and resources to perform safely. When the BOP is lifted in such a manner, it is unwieldy and difficult to maneuver due to the precarious nature of suspending such a heavy load. The lifting of a BOP presents particular safety concerns to the crew working around it, as a mishap and slip of the BOP from the lifting assembly may severely injure crew members.

Prior art provides a two piece lifting assembly that is assembled around the stack. It requires alignment of two separate lifting assemblies around the BOP stack. Prior art pins are large and horizontally mounted, and are thus difficult to install and not held in place by gravity.

Thus, there remains a need for a BOP lifting apparatus that will increase the efficiency and safety of the handling of a BOP stack during rig up, rig down and transport operations. There additionally remains a need for a BOP stack lifting apparatus that can remain stable in the event of a failure or breakage in cables used in the lifting process.

The various embodiments of the present invention disclosed herein address one or more of the problems set forth above.

SUMMARY OF THE INVENTION

Certain aspects of some embodiments disclosed herein are set forth below. It should be understood that these aspects are presented merely to provide the reader with a brief summary of certain forms the invention might take and that these aspects are not intended to limit the scope of the invention. Indeed, the invention may encompass a variety of aspects that may not be set forth below.

The present invention provides for a BOP lifting apparatus for securing and lifting a complete BOP stack. In an embodiment of the invention, the lifting apparatus is comprised of a reinforced frame and a latching gate for securing a BOP stack within the lifting apparatus. The frame has a central U-shaped recess that is sized and shaped for securing a mid-section or collared portion of the BOP stack. The gate pivotally swings between a secured, closed position on the frame and an open position for convenient installation and removal of the lifting apparatus from the BOP stack. An actuator has a first end connected to a top surface of the frame and a second end connected to the gate for actuating the opening and closing of the gate to the frame. Once the gate is moved into the closed position, one or more locking pins are inserted into pinning holes located on the gate in alignment with pinning holes located on the frame of the lifting apparatus. Upon inserting all locking pins, the lifting apparatus will securely restrain the BOP stack during transport and installation. The fully secured lifting apparatus may then itself be lifted via cables or other lifting mechanisms attached to the lifting apparatus via lifting eyelets located on the corners of the frame.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein. Additionally, as used herein, the term "substantially" is to be construed as a term of approximation.

Figure 1:
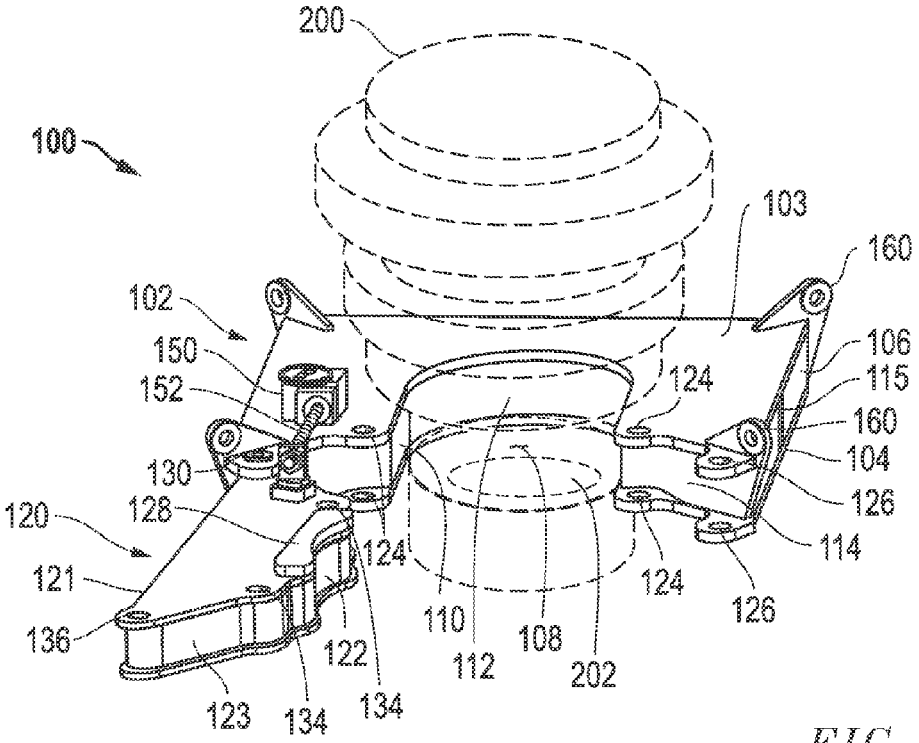
FIG. 1 is a perspective view of a lifting apparatus for a BOP stack illustrating a gate in the open position.

Turning to FIG. 1, a BOP lifting apparatus 100 is shown. Apparatus 100 is comprised of a frame 102 and a gate 120 for securing a BOP or BOP stack 200 during lifting, positioning, and/or handling. Frame 102 is secured to collared portion 202 of BOP stack 200, as shown in outline. Frame 102 may be integrally formed from a hard, reinforced metal, such as steel and the like, and has a top plate 103 and opposite bottom plate 105 (FIG. 2) with a series of three consecutive sidewalls 104 terminating at a pair of corners 106 at each intersection of adjacent sidewalls 104 (see FIG. 3).

A U-shaped central recess 108 is located between sidewalls 104 and corners 106. Central recess 108 is comprised of a radiused portion 112 disposed between a pair of inner walls 110. Radiused portion 112 conforms to the contours of collared portion 202 of BOP stack 200. In a preferred embodiment, opposing parallel inner walls 110 are spaced apart at a distance no less than that of the diameter of radiused portion 112 and connect tangentially to radiused portion 112.

A pair of transition walls 114 extends between an end of each of parallel inner walls 110 and a sidewall 104 at corners 106. Transition walls 114 form an enlarged opening opposite the radiused portion 112. Transition walls 114 extend toward and terminate at corners 106.

Figure 2:
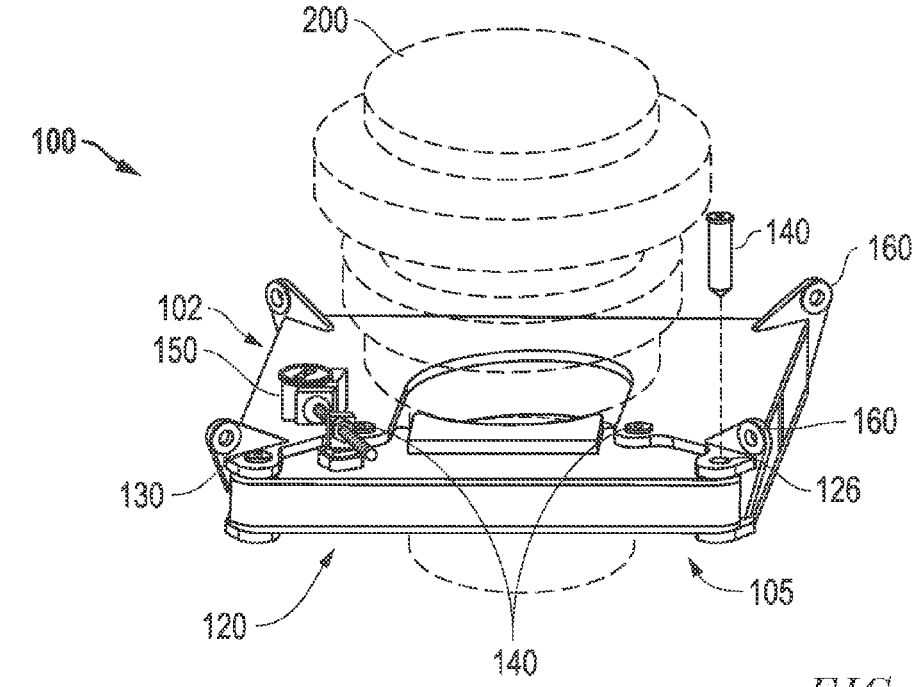
FIG. 2 is another perspective view of the lifting apparatus shown in FIG. 1 with the gate illustrated in the closed position.

Gate 120 is pivotally connected to a corner 106 of frame 102 via a gate pin 130. Gate 120 may be fabricated of the same material as frame 102 and is comprised of an outer wall 121 and a radiused inner wall 122 that are connected by sidewalls 123. Outer wall 121 has substantially the same length as sidewalls 104 of frame 102, but may have a height that is less than the height of the frame 102. Radiused inner wall 122 has a substantially similar radial length of that of radiused portion 112. When gate 120 is in the closed position (as shown in FIG. 2), opposing inner walls 110, radiused portion 112, and radiused inner wall 122 of gate 120 together secure the collared portion 202 of BOP stack 200 such that BOP stack 200 is safely and properly restrained by the lifting apparatus 100. When moved to a closed position, gate 120 and frame 102 come together to form the complete lifting apparatus 100 that is able to securely hold BOP stack 200. In this closed position, transition walls 114 of frame 102 and the sidewalls 123 of gate 120 are engaged to help prevent reopening of gate 120.

Gate 120 must be significantly robust to endure the off-center lifting of the extremely heavy BOP stack 200. However, it is also important to control the opening of gate 120 to permit approach movement in closed spaces to access BOP stack 200. It is also important to be able to close gate 120 without the aid of supplemental lifting equipment, such as a forklift, when frame 102 is successfully positioned around BOP stack 200.

The closing and opening of gate 120 is accomplished by way of an actuator 150, which is pivotally connected to the top of frame 102. During opening or closing of gate 120, actuator 150 rotates a threaded rod 152 in a first direction or an opposite second direction. Threaded rod 152 has an end opposite actuator 150 that is threaded through a nut assembly 154 (shown in FIG. 3) attached to the top surface of gate 120. Thus, the rotation of threaded rod 152 induces nut assembly 154 to travel either inward or outward with respect to actuator 150 attached to the top of frame 102. Nut assembly 154 consequently moves gate 120 inward or outward toward a closed or open position, respectively. Gate 120 may be opened or closed depending on the rotational direction of the threaded rod 152 controlled by the actuator 150. As a result, gate 120 will not be allowed to swing freely, creating a hazard. Also, envelope width of BOP lifting apparatus 100 can be limited for approach and departure from BOP stack 200 in close quarters such as under a substructure of a drilling rig.

Besides controlled opening and closing of gate 120, it is important to provide absolute secure lifting of BOP stack 200, even when such lifting effort is unbalanced, such as to put an unequal load on gate 120. To satisfy the requirement to provide a secure lock between gate 120 and frame 102, a series of aligned pinning holes 124, 126 and 134, 136 are located on frame 102 and gate 120, respectively, for locking with locking pins 140. More specifically, frame 102 has inner pinning holes 124 and a corner pinning hole 126 located at the intersection of a transition wall 114 and a sidewall 106. This location is opposite gate pin 130. Inner pinning holes 124 are located adjacent to each intersection of a parallel inner wall 110 with a transition wall 114, on opposite sides of the open portion of the central recess 108. Gate 120 has matching inner pinning holes 134 and at least one corner pinning hole 136. Inner pinning holes 134 are located adjacent to each intersection of the radiused inner wall 122 and sidewalls 123, with corner pinning hole 136 located on the corner of gate 120 opposite gate pin 130. Inner pinning holes 134 and corner pinning hole 136 are located such that they are aligned to the respective inner pinning holes 124 and corner pinning hole 126 when gate 120 is pivotally rotated to the closed position.

In the embodiment illustrated, the pinning holes located on frame 102 overlap the pinning holes located on gate 120. In the embodiment illustrated, when gate 120 is in the closed position, gate 120 intersects slightly into the body of frame 102 due to the height of gate 120 being less than the height of frame 102. The pinning holes located on frame 102 thus overlap and cover up the pinning holes located on gate 120. Because the height of gate 120 is unequal to the height of frame 102, the height difference would create an unbalanced lifting force on BOP stack 200 during lifting and transport. Thus, a gate pad 128 is located on top of gate 120 to provide support for BOP stack 200 over gate 120, thereby equalizing the height differential between gate 120 and frame 102.

On each corner 106 of frame 102, a lifting eyelet 160 is provided for attachment of cables or other lifting systems for lifting the apparatus 100 together with the secured BOP stack 200. Lifting eyelets 160 are located close to corners 106 to maximize stability of lifting apparatus 100 during the lifting and handling process. Ideally, at least four eyelets 160 are located equidistant from the center of frame 102 to maintain a stable platform for the lifting and handling of apparatus 100. Moreover, lifting eyelets 160 may be equidistant from adjacent eyelets 160. Lifting eyelets 160 may be integrally formed as part of frame 102, or may be separately attached to frame 102. Preferably, lifting eyelets 160 are integrally formed with frame 102 or welded onto the surface of frame 102 to maximize the strength of eyelets 160, in view of the significant stress that will be placed upon BOP lifting apparatus 100 during operation.

Turning to FIG. 2, once gate 120 is set in the closed position, one or more locking pins 140 may be inserted into the aligned inner pinning holes 124, 134 and aligned corner pinning holes 126, 136 to fully secure BOP stack 200 within lifting apparatus 100. This is more clearly seen in the present figure, wherein one of the locking pins 140 is about to be inserted into a set of aligned inner pinning holes 124, 134 located on frame 102 and gate 120, respectively. Additionally, locking pins 140 have previously been inserted into the other sets of aligned inner pinning holes 124, 134, and corner pinning holes 126, 136.

Figure 3:
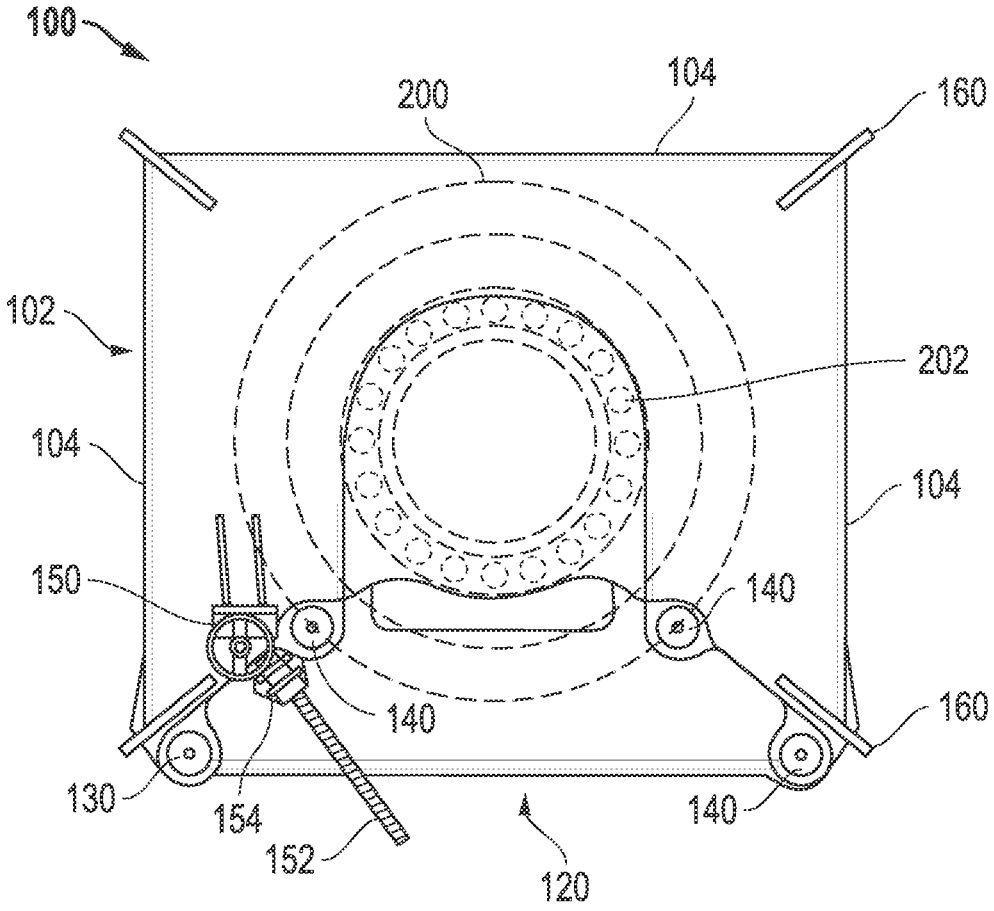
FIG. 3 is a top down view of the lifting apparatus of FIG. 1 with the gate illustrated as held in the closed position via a series of locking pins.

FIG. 3 is a top view of lifting apparatus 100 together with BOP stack 200, with BOP stack 200 secured within frame 102 and closed gate 120. In this figure, gate 120 is in the closed position, with locking pins 140 inserted into the various pinning holes located along the connection between frame 102 and gate 120. As can be seen in this figure, when gate 120 is closed, the radiused inner wall 122 of gate 120 and the parallel inner walls 110 and radiused portion 112 of frame 102 together generally form the circumference of a circle that is shaped and sized to be approximately the same as the collared portion 202, with small breaks between radiused inner wall 122 and parallel inner walls 110. This circle forms a tight, secure hold on a collared portion 202 of BOP stack 200.

Figure 4:
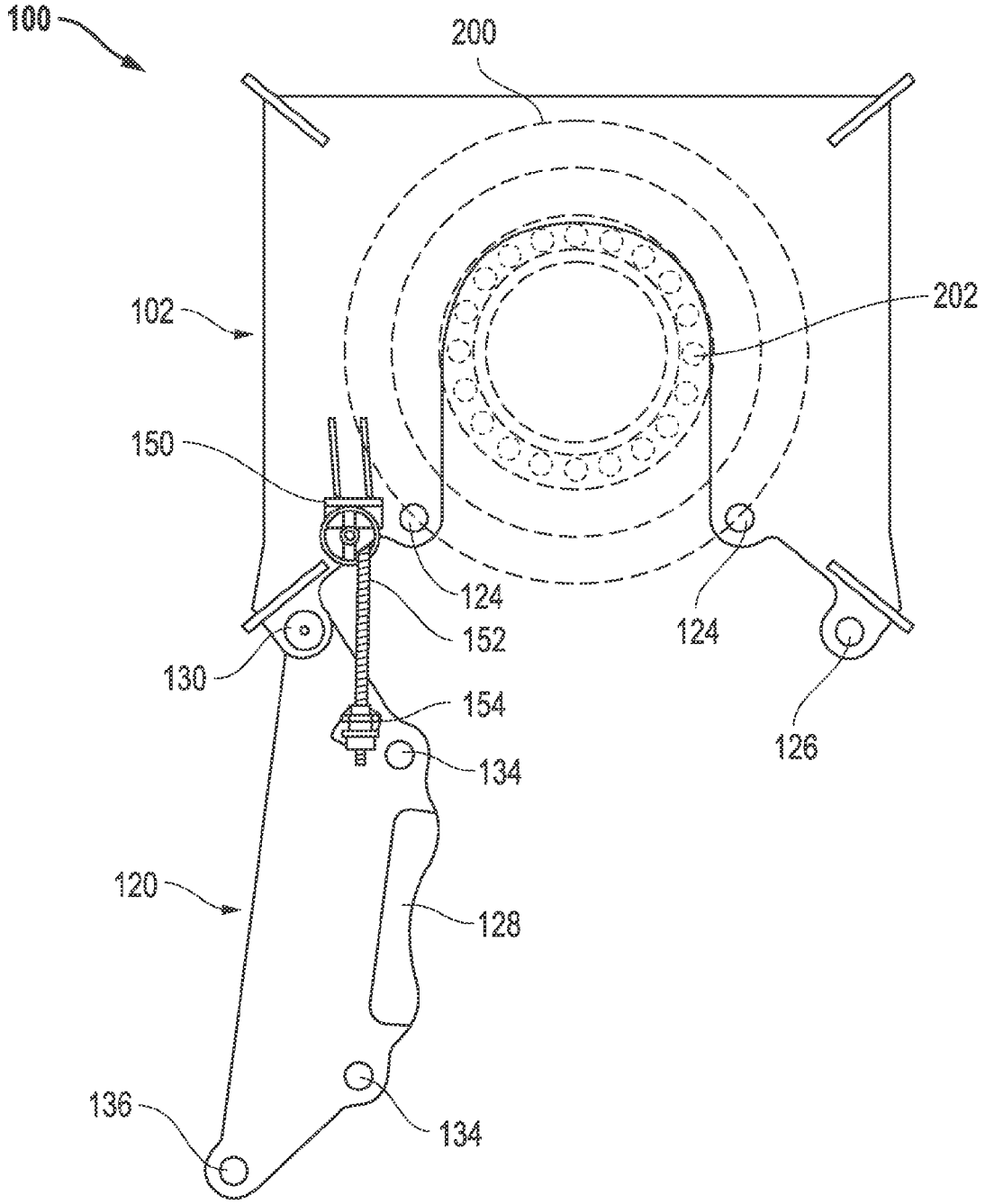
FIG. 4 is another top down view of the lifting apparatus shown in FIG. 1 with the gate moved to an open position by way of an actuator connected between the frame and gate.

FIG. 4 illustrates a top view of lifting apparatus 100 and BOP stack 200, with gate 120 in an open position as a result of threaded rod 152 being rotated by actuator 150 such that nut assembly 154 is at the end of travel along threaded rod 152. In this figure, it is more clearly seen how lifting apparatus 100 may be mounted to or removed from BOP stack 200. In particular, a well operator need only to align the central recess 108 with a collared portion 202 of BOP stack 200, and slide lifting apparatus 100 around collared portion 202 before actuating the gate from an open position to a closed position. Locking pins 140 are then inserted into inner pinning holes 134 and corner pinning hole 136 to form a secure connection.

During operation, the unique placement of lifting eyelets 160 on corners 106 of frame 102, as well as the unique shape of the gate 120 and placement of pinning holes 124, 126, 134, 136, results in the ability of gate 120 to remain closed even if a cable suspended from a lifting eyelet 160 were to break or otherwise become detached. That is, because the pinning holes are strategically located on gate 120 and frame 102, the connection between gate 120, frame 102 and locking pins 140 becomes tighter as lifting apparatus 100 deviates from a substantially horizontal plane.

Furthermore, due to the unique placement of lifting eyelets 160 and the overall balancing of lifting apparatus 100, even if an individual lifting point were to fail (either through detachment of a cable connected to a lifting eyelet 160, or failure of the eyelet 160 itself), the physical forces on the remaining cables and lifting eyelets 160 will be redistributed diagonally such that the three remaining lifting eyelets 160 and cables can maintain the balance of lifting apparatus 100 and BOP stack 200 without tipping and dropping it.

Figure 5:
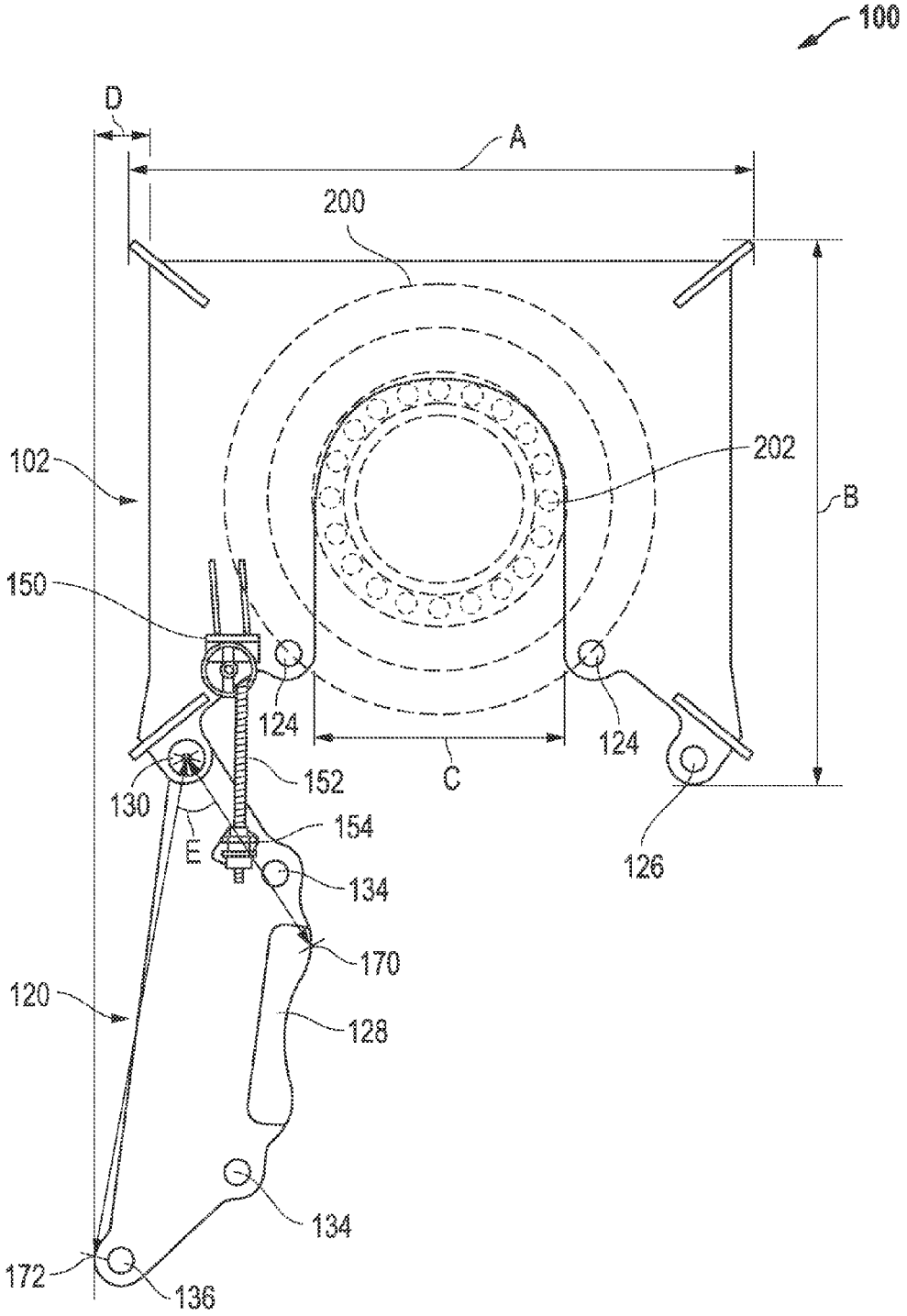
FIG. 5 is a top down view of the lifting apparatus shown in FIG. 4 illustrating dimensions that demonstrate the amount of opening required, and clearance required for the gate to move to a position by way of the actuator to permit positioning of the lifting apparatus on the BOP stack.

FIG. 5 is a top down view of lifting apparatus 100, illustrating dimensions that demonstrate the amount of opening required, and clearance required, for gate 120 to move to a position by way of actuator 150 to permit positioning of lifting apparatus 100 on BOP stack 200. As seen in FIG. 5, lifting apparatus 100 is designed to allow gate 120 to open sufficiently so as to allow frame 102 to approach or retreat from BOP stack 200 without creating an obstacle for retreat or approach that would normally result from opening gate 120. As illustrated, frame 102 has a closed travel envelope defined by dimensions A and B. Dimensions A and B define the amount of room required around frame 102 for moving frame 102 with BOP stack 200 enclosed therein. For use on tension leg platforms and submersible platforms, this space is critical.

Dimension C defines the free passage dimension required for connection to, and release from, BOP stack 200. Dimension D defines the increase in the dimension A travel envelope when gate 120 is opened. It is critical to minimize dimension D, without weakening frame 102.

Pins 124 are located in relationship to pin holes 134 so as to minimize dimension D. An open envelope point 172 is related to a clearance point 170 on gate 120. The angle between open envelope point 172 and clearance point 170 is angle E. Minimizing angle E is achieved by the deep inset location of pins 124.

Figure 6:
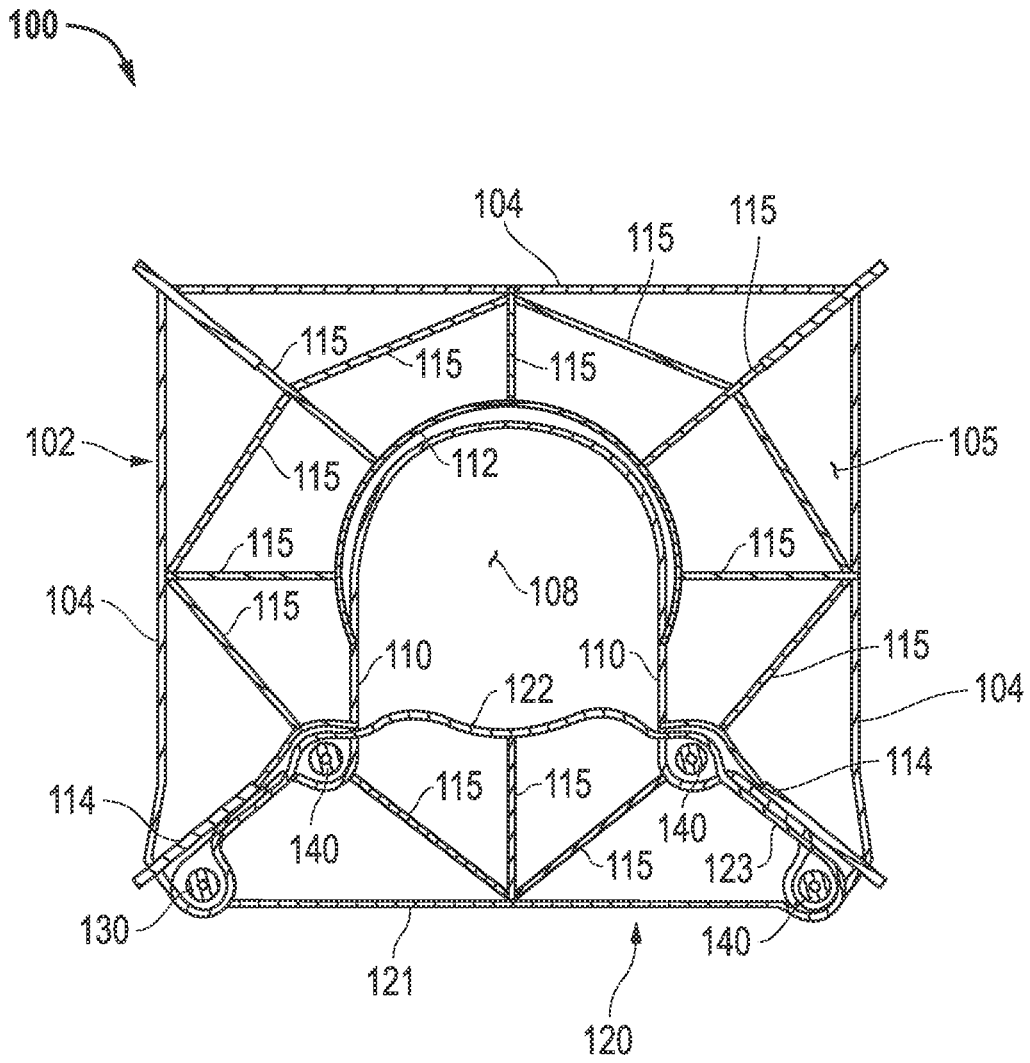
FIG. 6 is a cross-sectional, top view of the lifting apparatus of FIG. 1 with the gate illustrated as held in the closed position via a series of locking pins.

FIG. 6 is a cross-sectional, top view of lifting apparatus 100 with gate 120 illustrated as held in the closed position via locking pins 140 (not shown) in aligned pin holes pairs 124 and 134, and 126 and 136. Gate pin 130 provides the fourth latching pin to secure gate 120 to frame 102.

As seen in FIG. 6, the top plate 103 of frame 102 is removed to illustrate an embodiment that can be used to obtain the structural strength required for lifting apparatus 100 to be able to lift BOP stack 200 without collapsing or warping under the severe load. In this embodiment, a series of vertical beams 115 are disposed to form a load bearing web inside frame 102 and gate 120. In the embodiment illustrated, beams 115 are welded to bottom plate 105. Each beam 115 is disposed angularly to extend between a corner 106 and radiused portion 112, or between a sidewall 104 and radiused portion 112. Beams 115 may also be disposed between a sidewall 104 and another beam 115.

Inside gate 120, beams 115 may extend between outer wall 121 and radiused inner wall 122, and also between outer wall 121 and a sidewall 123. In the embodiment illustrated, beams 115 are advantageously disposed between outer wall 121 and inner walls 122 proximate to the location of pin holes 134.

As described, lifting apparatus 100 is easier to bring into place and lock into place than other devices, while providing stability in the event of failure of a lifting cable. When gate 102 of lifting apparatus 100 opens, it allows BOP stack 200 to clear moving frame 102 in the horizontal plane while maintaining a minimized travel envelope as defined by dimensions A and B (FIG. 5). To accomplish this combination of features, pin holes 124, 134, 126, 136 and gate pin 130 are designed in locations to minimize the opened envelope of lifting apparatus 100 and open gate 120.

In the embodiment illustrated, one permanent vertical pin is provided at gate pin 130. The three removable vertical pins (two at 124/134, one at 126/136) are all in a parallel plane, and are all located on one side of the centerline of lifting apparatus 100. In the embodiment illustrated, with four lifting eyelets 160 located at the corners of frame 102 and gate 120, if any lift point fails, the forces will be redistributed diagonally such that the other three can maintain the hold of BOP stack 200 without tipping or dropping it.

It will be readily apparent to those skilled in the art that the general principles defined herein may be applied to other embodiments and applications without departing from the spirit and scope of the present invention. Having thus described the exemplary embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is contemplated that the appended claims will cover any such modifications or embodiments that fall within the true scope of the invention.

What is claimed is:

1. A blowout preventer lifting apparatus comprising:

a frame having four corners connected by three sidewalls, and a U-shaped central recess disposed there between;

the central recess having opposing parallel inner walls and a radiused portion connecting the inner walls;

a transition wall extending outward from each of the parallel walls to the sidewalls to form an enlarged opening opposite the radiused portion;

an inner pinning hole on the frame, located adjacent to each intersection of the parallel inner walls and transition walls;

a corner pinning hole on the frame located adjacent to each intersection of the transition walls and the sidewalls;

a gate having an outer wall, a radiused inner wall, and a pair of sidewalls connecting the inner and outer walls;

the gate being pivotally connected to one of the corner pinning holes by a gate pin, the gate being movable between an open position and a closed position;

a pair of inner pinning holes on the gate aligned for pinned connection to the inner holes of the frame;

a corner pinning hole on the gate opposite the gate pin for pinned connection to a corner pinning hole on the frame; and, a lifting eyelet located at each corner of the frame.

2. The blowout preventer lifting apparatus of claim 1 further comprising:

a threaded actuator extending between the frame and the gate;

the actuator located over the transition wall proximate to the gate pin for moving the gate between a closed position and an open position.

3. The blowout preventer lifting apparatus of claim 1 further comprising:

the gate being located between two of the lifting eyelets of the frame opposite the radiused portion of the central recess.

4. The blowout preventer lifting apparatus of claim 1 further comprising:

the lifting eyelets being equidistant from the center of the frame, the lifting eyelets being equidistant from an adjacent eyelet.

5. The blowout preventer lifting apparatus of claim 1 further comprising:

the gate having a height less than the height of the frame;

the gate being partially recessed into the frame when the gate is in the closed position; and, the pinning holes of the frame aligning with the pinning holes of the gate when the gate is in the closed position.

6. The blowout preventer lifting apparatus of claim 5 further comprising:

a gate pad located on the gate for equalizing the height differential between the gate and the frame.

* * * * *